US006294876B1

(12) United States Patent
Ando et al.

(10) Patent No.: US 6,294,876 B1
(45) Date of Patent: Sep. 25, 2001

(54) ELECTRON-BEAM APPARATUS AND IMAGE FORMING APPARATUS

(75) Inventors: Muneki Ando, Atsugi; Kenji Shino, Yokohama, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/512,362

(22) Filed: Feb. 24, 2000

(30) Foreign Application Priority Data

Feb. 24, 1999 (JP) ..... 11-047125
Dec. 20, 1999 (JP) ..... 11-361254

(51) Int. Cl.[7] ..... G09G 3/10

(52) U.S. Cl. ..... 315/169.1; 315/168; 345/100; 345/132; 313/309

(58) Field of Search ..... 315/167, 168, 315/169.1, 169.2, 169.3, 169.4, 326, 334, 339; 345/74–76, 91, 92, 95, 98, 87, 100, 132; 313/309, 495

(56) References Cited

U.S. PATENT DOCUMENTS

| | | | | |
|---|---|---|---|---|
| 4,206,386 | * | 6/1980 | Akutsu et al. | 315/169.4 |
| 4,315,259 | * | 2/1982 | McKee et al. | 315/169.4 X |
| 4,904,895 | | 2/1990 | Tsukamoto et al. | 313/336 |
| 5,066,883 | | 11/1991 | Yoshioka et al. | 313/309 |
| 5,157,309 | | 10/1992 | Parker et al. | 315/169.1 |
| 5,569,974 | | 10/1996 | Morikawa et al. | 313/310 |
| 5,627,436 | * | 5/1997 | Suzuki et al. | 315/169.1 |
| 5,682,085 | | 10/1997 | Suzuki et al. | 315/169.1 |
| 5,939,824 | * | 8/1999 | Kishi et al. | 313/495 |
| 6,005,540 | * | 12/1999 | Shinjo et al. | 345/74 |
| 6,072,457 | * | 6/2000 | Hashimoto et al. | 345/100 |

FOREIGN PATENT DOCUMENTS

| | | |
|---|---|---|
| 0 596 242 A1 | 5/1994 | (EP) . |
| 0 686 960 A2 | 12/1995 | (EP) . |
| 64-31332 | 2/1989 | (JP) . |
| 2-257551 | 10/1990 | (JP) . |
| 3-55738 | 3/1991 | (JP) . |
| 4-28137 | 1/1992 | (JP) . |
| 9-90897 | 4/1997 | (JP) . |

OTHER PUBLICATIONS

J. Dyke et al., "Field Emission", Advances in Electronics and Electron Physics, vol. VIII, 1956, pp. 89–185.
M.I. Elinson et al., "The Emission of Hot Electrons and The Field Emission of Electrons From Tin Oxide", Radio Engineering and Electronic Physics, Jul. 1965, pp. 1290–1296.
H. Araki, "Electroforming and Electron Emission of Carbon Thin Films", Journal of the Vacuum, Society of Japan, 1983, pp. 22–29 (with English Abstract on p. 22).
G. Dittmer, "Electrical Conduction and Electron Emission of Discontinuous Thin Films", Thin Solid Films, 9, 1972, pp. 317–328.
M. Hartwell, "Strong Electron Emission From Patterned Tin–Indium Oxide Thin Films", IEDM, 1975, pp. 519–521.
C.A. Spindt, "Physical Properties of Thin–Film Emission Cathodes with Molybdenum Cones", J. Applied Physics, vol. 47, No. 12, Dec. 1976, pp. 5248–5263.
R. Meyer, "Recent Development on 'Microtips' Display at LETI", Tech. Digest of IVMC 91, 1991, pp. 6–9.
C.A. Mead, "Operation of Tunnel–Emission Devices", Journal of Applied Physics, Apr. 1961, pp. 646–652.

* cited by examiner

*Primary Examiner*—Haissa Philogene
(74) *Attorney, Agent, or Firm*—Fitzpatrick, Cella, Harper & Scinto

(57) ABSTRACT

This invention stabilizes the electron emission amount and displays an image on the entire display screen with a luminance faithful to an original image signal, while preventing characteristic degradation and destruction of an electron source. In an apparatus according to this invention, a V/I converter (108) includes n independent constant current sources in correspondence with n column-direction wirings. Each constant current source (108) is made up of an operational amplifier, transistor, and resistor. A voltage limiting circuit (209) uses a diode (D). A limit value setting circuit (110) is constituted by, e.g., a D/A converter and buffer amplifier or a potentiometer and buffer amplifier connected to a power supply. A spike current absorbing means (211) uses a capacitor (C). As the capacitance increases, the wiring voltage rise (ΔVs) decreases. Thus, the necessary capacitance of the capacitor (C) of the spike current absorbing means (211) is desirably 0.1 $\mu$F or more.

47 Claims, 9 Drawing Sheets

ELECTRON-BEAM APPARATUS AND IMAGE FORMING APPARATUS

FIELD OF THE INVENTION

The present invention relates to an electron-beam apparatus using an electron-emitting device and, more particularly, to an image forming apparatus using the structure of the electron-beam apparatus.

BACKGROUND OF THE INVENTION

Conventionally, two types of devices, namely thermionic and cold cathodes, are known as electron-emitting devices. Known examples of the cold cathodes are surface-conduction emission type electron-emitting devices, field emission type electron-emitting devices (to be referred to as FE type electron-emitting devices hereinafter), and metal/insulator/metal type electron-emitting devices (to be referred to as MIM type electron-emitting devices hereinafter).

A known example of the surface-conduction emission type electron-emitting devices is described in, e.g., M. I. Elinson, "Radio Eng. Electron Phys., 10, 1290 (1965) and other examples will be described later. The surface-conduction emission type electron-emitting device utilizes the phenomenon that electrons are emitted by a small-area thin film formed on a substrate by flowing a current parallel through the film surface. The surface-conduction emission type electron-emitting device includes electron-emitting devices using an Au thin film [G. Dittmer, "Thin Solid Films", 9,317 (1972)], an $In_2O_3/SnO_2$ thin film [M. Hartwell and C. G. Fonstad, "IEEE Trans. ED Conf.", 519 (1975)], a carbon thin film [Hisashi Araki et al., "Vacuum", Vol. 26, No. 1, p. 22 (1983)], and the like, in addition to an $SnO_2$ thin film according to Elinson mentioned above.

FIG. 4 is a plan view showing the surface-conduction emission type electron-emitting device by M. Hartwell et al. Referring to FIG. 4, reference numeral 3001 denotes a substrate; and 3004, a conductive thin film made of a metal oxide formed by sputtering. This conductive thin film 3004 has an H-shaped pattern, as shown in FIG. 4. An electron-emitting portion 3005 is formed by performing electrification processing (referred to as forming processing to be described later) with respect to the conductive thin film 3004. An interval L in FIG. 4 is set to 0.5 to 1 mm, and a width W is set to 0.1 mm. The electron-emitting portion 3005 is shown in a rectangular shape at the center of the conductive thin film 3004 for the sake of illustrative convenience. However, this does not exactly show the actual position and shape of the electron-emitting portion. In the above surface-conduction emission type electron-emitting devices by M. Hartwell et al. and the like, typically the electron-emitting portion 3005 is formed by performing electrification processing called forming processing for the conductive thin film 3004 before electron emission. In forming processing, a constant DC voltage or a DC voltage which increases at a very low rate of, e.g., 1 V/min is applied across the conductive thin film 3004 to partially destroy or deform the conductive thin film 3004, thereby forming the electron-emitting portion 3005 with an electrically high resistance. Note that the destroyed or deformed part of the conductive thin film 3004 has a fissure. Upon application of an appropriate voltage to the conductive thin film 3004 after forming processing, electrons are emitted near the fissure.

Known examples of the FE type electron-emitting devices are described in W. P. Dyke and W. W. Dolan, "Field emission", Advance in Electron Physics, 8, 89 (1956) and C. A. Spindt, "Physical properties of thin-film field emission cathodes with molybdenium cones", J. Appl. Phys., 47, 5248 (1976).

FIG. 5 is a sectional view showing the FE type electron-emitting device by C. A. Spindt et al. In FIG. 5, reference numeral 3010 denotes a substrate; 3011, an emitter wiring made of a conductive material; 3012, an emitter cone; 3013, an insulating layer; and 3014, a gate electrode. In this device, a voltage is applied between the emitter cone 3012 and gate electrode 3014 to emit electrons from the distal end portion of the emitter cone 3012. As another FE type device structure, there is an example in which an emitter and gate electrode are arranged on a substrate to be almost parallel to the surface of the substrate, in addition to the multilayered structure of FIG. 5.

A known example of the MIM type electron-emitting devices is described in C. A. Mead, "Operation of Tunnel-Emission Devices", J. Appl. Phys., 32,646 (1961).

FIG. 6 is a sectional view showing a typical example of the MIM type device structure. In FIG. 6, reference numeral 3020 denotes a substrate; 3021, a lower electrode made of a metal; 3022, a thin insulating layer having a thickness of about 100 Å; and 3023, an upper electrode made of a metal and having a thickness of about 80 to 300 Å. In the MIM type electron-emitting device, an appropriate voltage is applied between the upper and lower electrodes 3023 and 3021 to emit electrons from the surface of the upper electrode 3023.

Since the above-described cold cathodes can emit electrons at a temperature lower than that for thermionic cathodes, they do not require any heater. The cold cathode has a structure simpler than that of the thermionic cathode and can shrink in feature size. Even if a large number of devices are arranged on a substrate at a high density, problems such as heat fusion of the substrate hardly arise. In addition, the response speed of the cold cathode is high, while the response speed of the thermionic cathode is low because thermionic cathode operates upon heating by a heater.

For this reason, applications of the cold cathodes have enthusiastically been studied.

Of cold cathodes, the surface-conduction emission type electron-emitting devices have a simple structure and can be easily manufactured, and thus many devices can be formed on a wide area. As disclosed in Japanese Patent Laid-Open No. 64-31332 filed by the assignee of the present applicant, a method of arranging and driving a lot of devices has been studied.

Regarding applications of the surface-conduction emission type electron-emitting devices to, e.g., image forming apparatuses such as an image display apparatus and image recording apparatus, charge beam sources, and the like have been studied.

Particularly as an application to image display apparatuses, as disclosed in the U.S. Pat. No. 5,066,883 and Japanese Patent Laid-Open Nos. 2-257551 and 4-28137 filed by the assignee of the present applicant, an image display apparatus using a combination of an surface-conduction emission type electron-emitting device and a fluorescent substance which emits light upon irradiation of an electron beam has been studied. This type of image display apparatus using a combination of the surface-conduction emission type electron-emitting device and fluorescent substance is expected to exhibit more excellent characteristics than other conventional image display apparatuses. For example, compared with recent popular liquid crystal display apparatuses, the above display apparatus is superior in that it does not require any backlight because it is of a self-emission type and that it has a wide view angle.

A method of driving a plurality of FE type electron-emitting devices arranged side by side is disclosed in, e.g., U.S. Pat. No. 4,904,895 filed by the assignee of the present applicant. As a known example of an application of FE type electron-emitting devices to an image display apparatus is a flat panel display reported by R. Meyer et al. [R. Meyer: "Recent Development on Microtips Display at LETI", Tech. Digest of 4th Int. Vacuum Microelectronics Conf., Nagahama, pp. 6–9 (1991)]. An application of a larger number of MIM type electron-emitting devices arranged side by side to an image display apparatus is disclosed in Japanese Patent Laid-Open No. 3-55738 filed by the assignee of the present applicant.

The present inventors have examined surface-conduction emission type electron-emitting devices of various materials, various manufacturing methods, and various structures, in addition to the above-mentioned conventional surface-conduction emission type electron-emitting device. Further, the present inventors have made extensive studies on a multi electron-beam source having a large number of surface-conduction emission type electron-emitting devices, and an image display apparatus using this multi electron-beam source.

FIG. 7 is a schematic view showing a multi electron-beam source according to an electrical wiring method examined by the present inventors. That is, a large number of surface-conduction emission type electron-emitting devices are two-dimensionally arranged in a matrix to obtain a multi electron-beam source, as shown in FIG. 7. Referring to FIG. 7, numeral 4001 denotes a surface-conduction emission type electron-emitting device; 4002, a row-direction wiring; and 4003, a column-direction wiring. The row- and column-direction wirings 4002 and 4003 actually have finite electrical resistances, which are represented as wiring resistances 4004 and 4005 in FIG. 7. This wiring method is called a simple matrix wiring method. For the illustrative convenience, the multi electron-beam source is illustrated in a 6×6 matrix, but the size of the matrix is not limited to this. For example, in a multi electron-beam source for an image display apparatus, a number of devices enough to perform a desired image display are arranged and wired.

In a multi electron-beam source in which surface-conduction emission type electron-emitting devices are arranged in a simple matrix, appropriate electrical signals are applied to the row- and column-direction wirings 4002 and 4003 to output a desired electron beam. For example, to drive the surface-conduction emission type electron-emitting devices on an arbitrary row in the matrix, a selection voltage Vs is applied to the column-direction wiring 4002 on the row to be selected, and at the same time, a non-selection voltage Vns is applied to the row-direction wirings 4002 on unselected rows. In synchronism with this, a driving voltage Ve for outputting an electron beam is applied to the column-direction wirings 4003. According to this method, when voltage drops across the wiring resistances 4004 and 4005 are neglected, a voltage (Ve−Vs) is applied to the surface-conduction emission type electron-emitting device on the selected row, and a voltage (Ve−Vns) is applied to the surface-conduction emission type electron-emitting devices on the unselected rows. When the voltages Ve, Vs, and Vns are set to appropriate levels, an electron beam having a desired intensity must be output from only the surface-conduction emission type electron-emitting device on the selected row. When different driving voltages Ve are applied to the respective column-direction wirings, electron beams having different intensities must be output from respective devices on the selected row. Since the surface-conduction emission type electron-emitting device has a high response speed, a time for outputting an electron beam can be changed by changing a time for applying the driving voltage Ve.

A multi electron-beam source obtained by arranging surface-conduction emission type electron-emitting devices in a simple matrix has a variety of applications. For example, when a voltage signal corresponding to image information is appropriately applied, the multi electron-beam source can be applied as an electron source for an image display apparatus.

FIG. 8 is a partially cutaway perspective view of a display panel to which the multi electron-beam source is applied, showing the internal structure of the panel. In FIG. 8, reference numeral 1005 denotes a rear plate; 1006, a side wall; and 1007, a face plate. The rear plate 1005, side wall 1006, and face plate 1007 constitute an airtight container for maintaining the inside of the display panel vacuum. To construct the airtight container, it is necessary to seal-connect the respective parts to obtain sufficient strength and maintain airtight condition. For example, frit glass is applied to junction portions, and sintered at 400 to 500° C. in air or nitrogen atmosphere, thus the parts are seal-connected. A method for exhausting air from the inside of the container will be described later.

The rear plate 1005 has a substrate 1001 fixed thereon, on which n×m cold cathode devices 1002 are formed (m, n=positive integer equal to 2 more, properly set in accordance with a desired number of display pixels. For example, in a display apparatus for high-resolution television display, preferably n=3,000 or more, m=1,000 or more. In this prior art, n=3,072 or more, and m=1,024.) Then n×m cold cathode devices are arranged in a simple matrix with m row-direction wirings 1003 and n column-direction wirings 1004. The portion constituted by the substrate 1001 to column-direction wirings 1004 will be referred to as a multi electron-beam source.

In this prior art, the substrate 1001 of the multi electron-beam source is fixed to the rear plate 1005 of the airtight container. If, however, the substrate 1001 of the multi electron-beam source has sufficient strength, the substrate 1001 of the multi electron-beam source may also serve as the rear plate of the airtight container.

A fluorescent film 1008 is formed on the lower surface of the face plate 1007. As this prior art concerns a color display apparatus, the fluorescent film 1008 is coated with red (R), green (G), and blue (B) fluorescent substances, i.e., three primary color fluorescent substances used in the CRT field. In FIG. 9A, the respective color fluorescent substances are formed into a striped structure, and black conductive members are provided between the stripes of the fluorescent substances. The purpose of providing the black conductive members is to prevent display color misregistration even if the electron-beam irradiation position is shifted to some extent, to prevent degradation of display contrast by shutting off reflection of external light, to prevent the charge-up of the fluorescent film by the electron beam, and the like. As a material for the black conductive members, graphite is used as a main component, but other materials may be used so long as the above purpose is attained. Further, the fluorescent substances of three primary colors are not limited to the striped layout as shown in FIG. 9A.

The fluorescent substances of three primary colors are formed in a delta layout in FIG. 9B, and may be formed in another layout.

Note that when a monochrome display panel is formed, a single-color fluorescent substance may be applied to the fluorescent film, and the black conductive member may be omitted.

A metal back 1009, which is well-known in the CRT field, is provided on the fluorescent film 1008 on the rear plate side. The purpose of providing the metal back 1009 is to improve the light-utilization ratio by mirror-reflecting part of the light emitted by the fluorescent film 1008, to protect the fluorescent film 1008 from collision with negative ions, to be used as an electrode for applying an electron-beam accelerating voltage, to be used as a conductive path for electrons which excited the fluorescent film 1008, and the like. The metal back 1009 is formed by forming the fluorescent film 1008 on the face plate substrate 1007, smoothing the front surface of the fluorescent film, and depositing Al thereon by vacuum deposition. Note that when fluorescent substances for a low voltage is used for the fluorescent film 1008, the metal back 1009 is not used.

For application of an accelerating voltage or improvement of the conductivity of the fluorescent film, transparent electrodes made of, e.g., ITO may be provided between the face plate substrate 1007 and the fluorescent film 1008.

Dx1 to Dxm, Dy1 to Dyn, and Hv are electric connection terminals for an airtight structure provided to electrically connect the display panel to an electric circuit (not shown). Dx1 to Dxm are electrically connected to the row-direction wirings 1003 of the multi electron-beam source; Dy1 to Dyn, to the column-direction wirings 1004 of the multi electron-beam source; and Hv, to the metal back 1009 of the face plate.

To evacuate the airtight container, after forming the airtight container, an exhaust pipe and vacuum pump (neither is shown) are connected, and the airtight container is evacuated to a vacuum of about $10^{-7}$ Torr. Thereafter, the exhaust pipe is sealed. To maintain the vacuum degree in the airtight container, a getter film (not shown) is formed at a predetermined position in the airtight container immediately before/after sealing. The getter film is a film formed by heating and evaporating a getter material mainly consisting of, e.g., Ba by a heater or RF heating. The suction effect of the getter film maintains a vacuum of $1\times10^{-5}$ to $1\times10^{-7}$ Torr in the container.

A voltage corresponding to a video signal is applied to the terminals Dxn and Dyn of the display panel, while a voltage of several kV to several ten kV is applied to the terminal Hv. Then, an electron beam emitted by the multi electron-beam source is accelerated toward the face plate 1007 to irradiate the fluorescent film 1008, which emits light. By sequentially switching devices to be driven, the face plate surface is sequentially scanned to display an image.

However, when the multi electron-beam source is actually connected to a voltage source and driven by this voltage application method, the voltage effectively applied to respective surface-conduction emission type electron-emitting devices varies owing to a voltage drop caused by the wiring resistance.

As the first cause of varying the voltage applied to respective devices, the surface-conduction emission type electron-emitting devices have different wiring lengths, i.e., different wiring resistances in the simple matrix wiring.

Second, the magnitudes of voltage drops caused by the wiring resistances 4004 at the respective portions of the row-direction wiring are nonuniform. This is because a current branches and flows from the row-direction wiring of a selected row to respective surface-conduction emission type electron-emitting devices connected to the row, and thus currents flowing through the respective wiring resistances 4004 become nonuniform.

Third, the magnitude of a voltage drop caused by the wiring resistance changes depending on a driving pattern or a display image pattern in the image display apparatus. This is because a current flowing through the wiring resistance changes depending on the driving pattern.

Due to these causes, if the voltage applied to respective surface-conduction emission type electron-emitting devices varies, the intensity of an electron beam output from each surface-conduction emission type electron-emitting device shifts from a desired value disadvantageously. For example, when surface-conduction emission type electron-emitting devices are applied to an image display apparatus, the luminance of a display image becomes nonuniform or varies depending on the display image pattern.

Variations in voltage become more noticeable for a larger simple matrix size. This limits the number of pixels in the image display apparatus.

The present inventors have enthusiastically studied a different driving method from the above voltage application method.

That is, in driving a multi electron-beam source obtained by arranging surface-conduction emission type electron-emitting devices in a simple matrix, the column-direction wiring is connected not to a voltage source for applying the driving voltage Ve but to a current source for supplying a current necessary to output a desired electron beam. This method pays attention to a strong correlation between a current flowing through the surface-conduction emission type electron-emitting device, i.e., device current If, and an emitted electron beam, i.e., emission current Ie. By controlling the device current If, the emission current Ie is controlled.

The device current If to be flowed through each surface-conduction emission type electron-emitting device is determined with reference to the device current If vs. emission current Ie characteristic, and supplied from the current source connected to the column-direction wiring. More specifically, a driver may be constituted by combining a memory which stores the device current If vs. emission current Ie characteristic, an arithmetic unit for determining the device current If to be flowed, and an electric circuit such as a control power source. The control current source may adopt a circuit form of temporarily converting the device current If to be flowed into a voltage signal and then converting the voltage signal into a current by a voltage-to-current converter.

This method can reduce the influence of a voltage drop caused by the wiring resistance, compared to the above-mentioned method of connecting the voltage source and driving the electron-emitting device. Hence, variations in output electron-beam intensity can be effectively reduced.

SUMMARY OF THE INVENTION

It is an object of the present invention to realize a preferable electron-beam apparatus and image forming apparatus.

The present invention discloses the following aspects as an arrangement for obtaining a desired electron-beam apparatus.

One aspect of the electron-beam apparatus according to the present invention comprises the following arrangement.

An electron-beam apparatus comprises an airtight container having an electron-emitting device, a wiring connected to the electron-emitting device, and an electrode which receives a potential for accelerating an electron emitted by the electron-emitting device, and a current absorbing unit which can be electrically connected to the wiring, the current absorbing unit absorbing a current generated by discharge in the airtight container.

Another aspect of the electron-beam apparatus according to the present invention comprises the following arrangement.

An electron-beam apparatus comprises an airtight container having an electron-emitting device, a wiring connected to the electron-emitting device, and an electrode which receives a potential for accelerating an electron emitted by the electron-emitting device, a bypass which can be electrically connected to the wiring, and a switch for electrically connecting the wiring and the bypass when discharge occurs in the airtight container.

In this case, the switch preferably operates depending on a potential difference between a wiring-side potential and a bypass-side potential. The switch may receive a predetermined potential as the bypass-side potential. The predetermined potential is desirably adjustable. As the switch, any switch can be used so far as it performs switching operation, and particular switching operation corresponding to the potential difference between terminals. For example, a non-linear device such as a diode can be preferably used.

The bypass preferably comprises absorbing means for absorbing a current generated by discharge.

The bypass preferably comprises a capacitor. The capacitor can absorb a current generated by discharge.

The electron-beam apparatus preferably further comprises a driver for supplying a signal for driving the electron-emitting device to the wiring. An example of the driving signal is a signal for controlling emission of electrons from the electron-emitting device. Electron emission can be controlled by the peak value or application time of a signal.

The driver is preferably a circuit for generating a current having a predetermined current value. This circuit can be formed from a known current source such as a current mirror circuit.

Note that a generated current may flow from the driver to the wiring or from the wiring to the driver. At the output (contact with the wiring) of the driver, a current having a predetermined current value suffices to be generated. The predetermined current value can be properly set.

The switch preferably serves as a switch for electrically connecting the bypass and the driver when a potential at an output terminal of the driver for supplying a current to the wiring falls outside a predetermined range. When the switch electrically connects the bypass and the driver, the bypass functions as a current path capable of flowing at least part of a current the driver tries to flow. This can quickly cancel a state in which the potential at the output terminal of the driver has a value falling outside a predetermined range.

The present invention includes still another aspect of the electron-beam apparatus having the following arrangement.

An electron-beam apparatus comprises an airtight container having an electron-emitting device, a wiring connected to the electron-emitting device, and an electrode which receives a potential for accelerating an electron emitted by the electron-emitting device, and a capacitor which can be electrically connected to the wiring.

In this case, the electron-beam apparatus preferably further comprises a switch which is interposed between the wiring and the capacitor and electrically connects the wiring and the capacitor depending on a wiring-side potential. The switch preferably operates depending on a potential difference between the wiring-side potential and a capacitor-side potential. The switch desirably receives a predetermined potential as the capacitor-side potential. As described above, a diode can be preferably used.

The capacitor used in this aspect preferably has an electrostatic capacitance of not less than 0.1 $\mu$F.

Each of the above-described aspects can adopt an arrangement in which the electron-emitting device includes a plurality of electron-emitting devices, the wiring includes wirings for the respective electron-emitting devices, and the current absorbing unit, bypass, or capacitor includes a plurality of current absorbing units, bypasses, or capacitors arranged in correspondence with the respective wirings, or an arrangement in which one current absorbing unit, bypass, or capacitor corresponds to the plurality of wirings. The latter simplifies the arrangement.

The present invention includes the following aspect of the electron-beam apparatus.

An electron-beam apparatus comprises an airtight container having a plurality of electron-emitting devices, a plurality of wirings which are connected to the electron-emitting devices and arranged in correspondence with the respective electron-emitting devices, and an electrode which receives a potential for accelerating electrons emitted by the electron-emitting devices, one bypass which can be electrically connected to the plurality of wirings, and switches for electrically connecting the wirings and the bypass.

In this case, the switches are preferably arranged for the respective wirings.

In the above-described aspects, it is preferable that the wiring be a first wiring, the apparatus further comprise a second wiring, and the electron-emitting device be connected to the first and second wirings. Pluralities of first and second wirings can be used to arrange a plurality of electron-emitting devices in a matrix. This aspect can preferably adopt an arrangement in which, for example, the second wirings serve as scanning wirings, a plurality of second wirings are sequentially selected, and a plurality of electron-emitting devices connected to a selected second wiring are driven by a plurality of first wirings.

As the electron-emitting device, a surface-conduction emission type electron-emitting device can be preferably employed, and a field emission type or metal/insulator/metal type (MIM type) electron-emitting device can also be adopted.

As one aspect of the image forming apparatus, the present invention includes an image forming apparatus comprising the above-described electron-beam apparatus, and a fluorescent substance for emitting light upon irradiation of an electron emitted by the electron-emitting device.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Embodiments of the present invention will be described below with reference to the accompanying drawings.

[First Embodiment]

Figure 1:
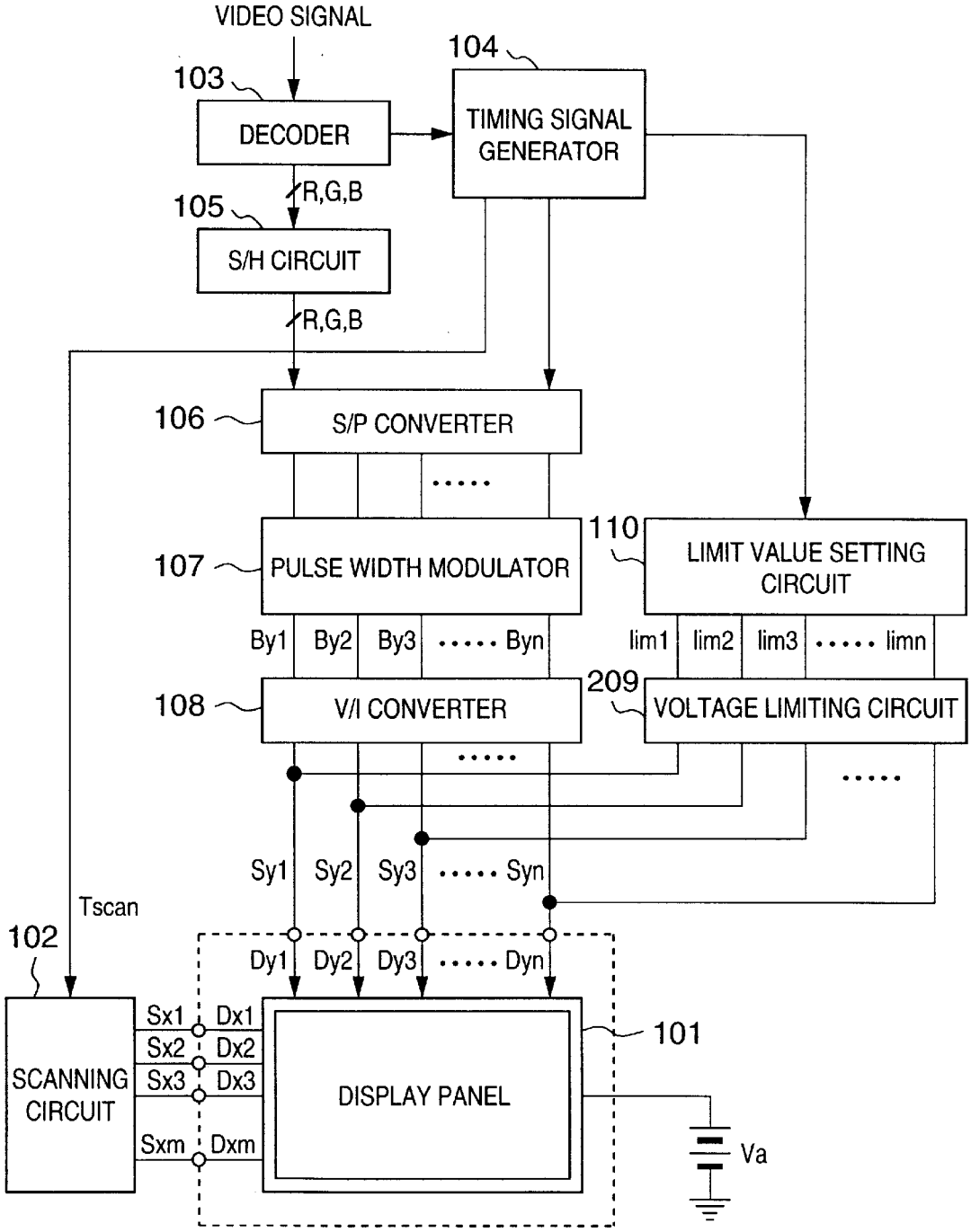
FIG. 1 a block diagram showing an image display apparatus according to the present invention.

FIG. 1 is a block diagram showing an image display apparatus according to the present invention. In FIG. 1, reference numeral 101 denotes an image display panel which is connected to an external electric circuit through terminals Dx1 to Dxm and Dy1 to Dyn. A high-voltage terminal on the image display panel is connected to an external high-voltage source Va to accelerate emitted electrons. The terminals Dx1 to Dxm receive a scan signal for sequentially scanning in units of rows a multi electron-beam source, i.e., surface-conduction emission type electron-emitting devices arranged in an M×N matrix formed in the panel. The terminals Dy1 to Dyn receive a modulated signal for controlling an output electron beam from each of surface-conduction emission type electron-emitting devices on a row selected by the scan signal.

A scanning circuit 102 will be explained. This circuit incorporates m switching devices. Each switching device selects either one of two different potentials (Vs and Vns), i.e., an output potential from a DC voltage source Vs (not shown) and 0 V (ground level), and is electrically connected to a corresponding one of the terminals Dx1 to Dxm of the display panel 101. The switching device operates based on a control signal output from a timing signal generator (to be described later). In practice, this switching device can be easily formed by a combination of switching devices such as FETs.

In the first embodiment, the DC voltage source Vs is set based on the characteristics (electron-emitting threshold voltage Vth of 8 V) of the surface-conduction emission type electron-emitting device, such that the potential difference from a potential applied to a column wiring becomes equal to or lower than the electron-emitting threshold voltage Vth when a connected electron-emitting device is not requested to emit electrons. In this case, the DC voltage source Vs is set to output a constant potential of 7 V.

The flow of an input image signal will be explained. An input composite image signal is separated into a luminance signal of three primary colors, and horizontal and vertical sync signals (HSYNC and VSYNC). A timing signal generator 104 generates various timing signals in synchronism with the signals HSYNC and VSYNC. The RGB luminance signal is sampled and held at a proper timing by an S/H circuit 105. The held signals are converted into serial signals in the alignment order of respective fluorescent substances of the image forming panel by a serial-to-parallel (S/P) converter 106.

Subsequently, a pulse width modulator 107 generates pulses each having a pulse width corresponding to the image signal intensity. The pulse voltages are converted into current signals (Sy1 to Syn) by a V/I converter 108 serving as a current driver. These current signals are supplied to surface-conduction emission type electron-emitting devices in the display panel 101 through the display panel terminals Dy1 to Dyn. In the panel which received the current output pulses, only surface-conduction emission type electron-emitting devices connected to a row selected by the scanning circuit 102 emit electrons only during a period corresponding to the supplied pulse width, thereby emitting light from fluorescent substances. By sequentially scanning rows selected by the scanning circuit 102, a two-dimensional image is formed.

At this time, the terminals of the V/I converter 108 for generating current signals (Sy1 to Syn) are connected to a voltage limiting circuit 209 which limits the amplitudes of the current signals (Sy1 to Syn).

Figure 2:
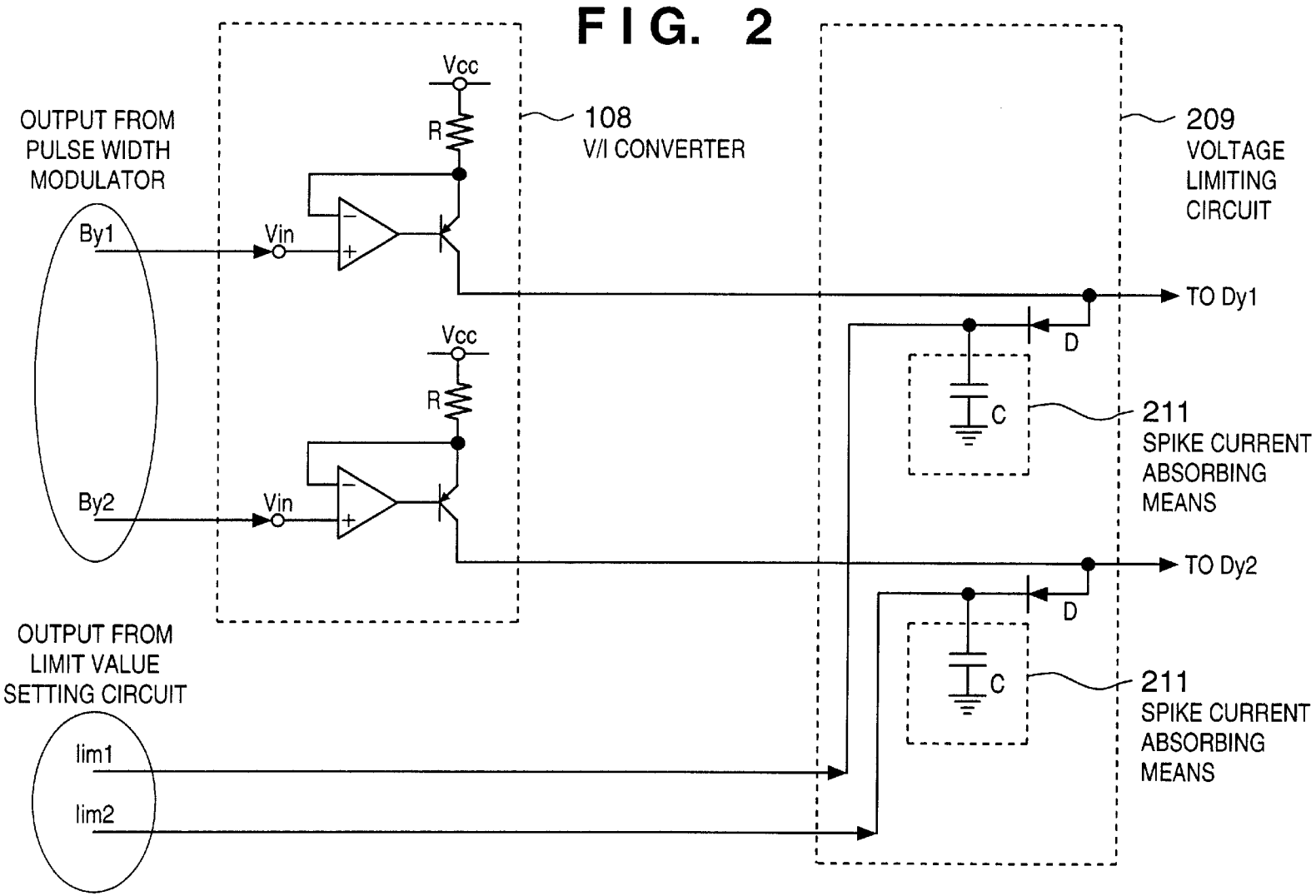
FIG. 2 is a block diagram showing a voltage-to-current converter and voltage limiting circuit in the first embodiment.

FIG. 2 is a block diagram showing the V/I converter 108 and voltage limiting circuit 209.

The V/I converter 108 has n independent constant current sources corresponding to n column-direction wirings. Each constant current source is made up of an operational amplifier, transistor, and resistor. A current output from each constant current source is determined by $$I=(Vcc-Vin)/R$$

where Vcc is the power supply potential, Vin is the non-inverted input potential of the operational amplifier, and R is the resistance value of the resistor. The input potential Vin is determined by an output from the pulse width modulator.

In the first embodiment, the constant current source of the V/I converter may take a current mirror output structure or constant current diode, in addition to the arrangement shown in FIG. 2.

The voltage limiting circuit 209 uses diodes D. The current output is connected to the anode side of each diode D used as a switch which operates in accordance with the potential, and the cathode potential is set by a limit value setting circuit 110 for outputting a reference potential. With this arrangement, the voltage limiting circuit 209 limits voltages (lim1 to limn). More specifically, let Vc be the cathode potential of the diode D. When an output from the V/I converter exceeds "Vc+VBE" (VBE is the forward voltage drop amount of the diode and is about 0.6 V), the diode D constituting the voltage limiting circuit 209 is turned on. Then, a current path capable of flowing a current in the forward direction of the diode D is electrically connected to the output of the V/I converter to clip an output from the V/I converter.

The limit value setting circuit 110 for setting the amplitude value of an output from the voltage limiting circuit 209 is constituted by, e.g., a D/A converter and buffer amplifier, or a potentiometer and buffer amplifier connected to the power supply.

Each spike current absorbing means 211 as a current absorbing means uses a capacitor C. When discharge occurs in the display panel (not shown), a large amount of charges flow into a wiring, and the wiring potential rises and exceeds the breakdown voltage of the electron-emitting device to degrade characteristics. In the circuit of FIG. 2, however, if the wiring potential rises, the diode D operating as a switch is turned on and connected as a wiring to a circuit on the capacitor C side serving as a bypass, and the capacitor C absorbs the charges generated by discharge. Consequently, the wiring potential does not extremely rise, and degradation of the characteristics of the electron-emitting device can be prevented.

A capacitance necessary for the capacitor C used in the spike current absorbing means 211 will be concretely calculated.

The discharge current and discharge duration time upon discharge in the display panel are measured to be about 10 A and about 10 nS, respectively. A charge amount ΔQs flowing into a wiring upon discharge is estimated to be about 10 μC (Coulomb). On the other hand, the allowable range of temporary rise of the wiring potential which does not degrade the characteristics of the electron-emitting device is desirably about 1 V. Letting Cs be the capacitance of the capacitor of the spike current absorbing means, a wiring potential rise ΔVs in the circuit of FIG. 2 is given by $$\Delta Qs = Cs_\Delta Vs$$

Letting ΔQs=10 μC and ΔVs=1 V, the necessary capacitance of the capacitor C is calculated as $$Cs = 0.1\ \mu F$$

As this capacitance increases, the wiring potential rise ΔVs decreases. Therefore, the necessary capacitance of the capacitor C of the spike current absorbing means 211 is desirably 0.1 μF or more.

Even if the panel specifications change to change the discharge current, a proper capacitance of the capacitor can be calculated again in this manner.

[Second Embodiment]

Figure 3:
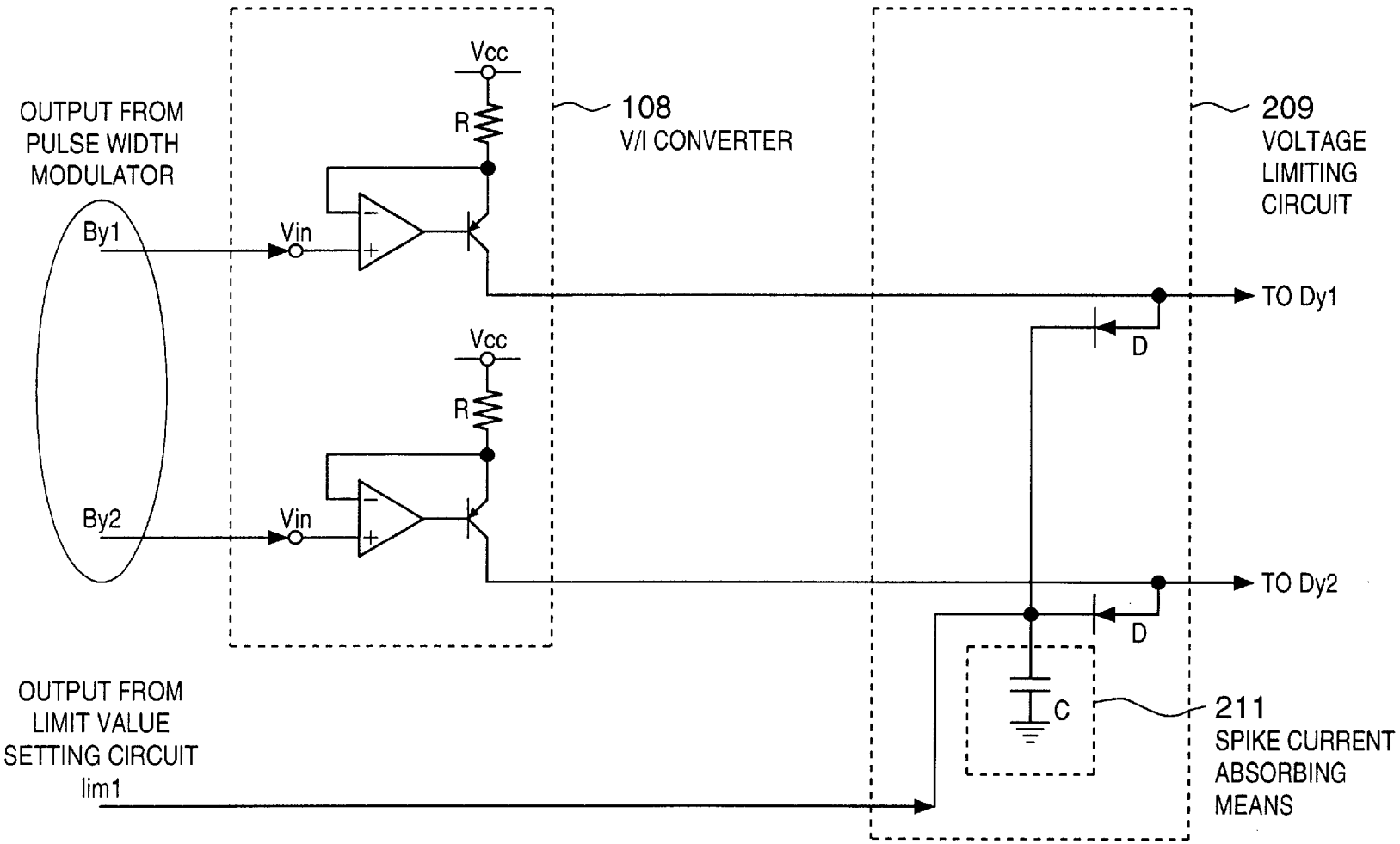
FIG. 3 is a block diagram showing a voltage-to-current converter and voltage limiting circuit in the second embodiment.
Figure 4:
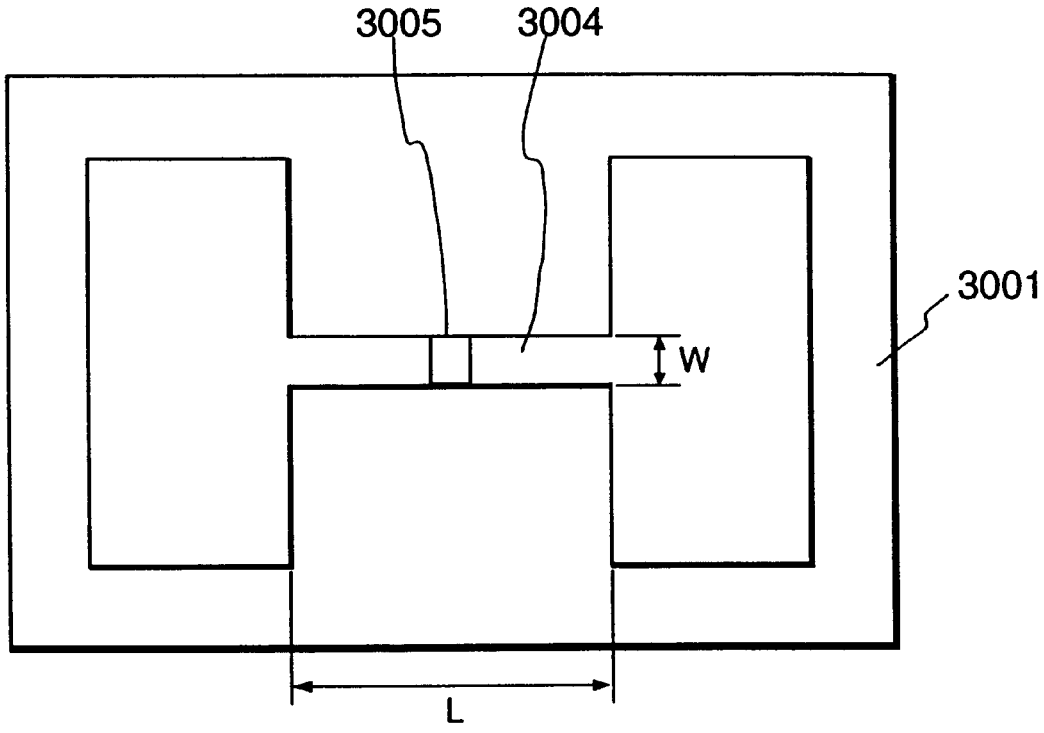
FIG. 4 PRIOR ART
FIG. 4 is a plan view showing a surface-conduction emission type electron-emitting device by Hartwell.
Figure 5:
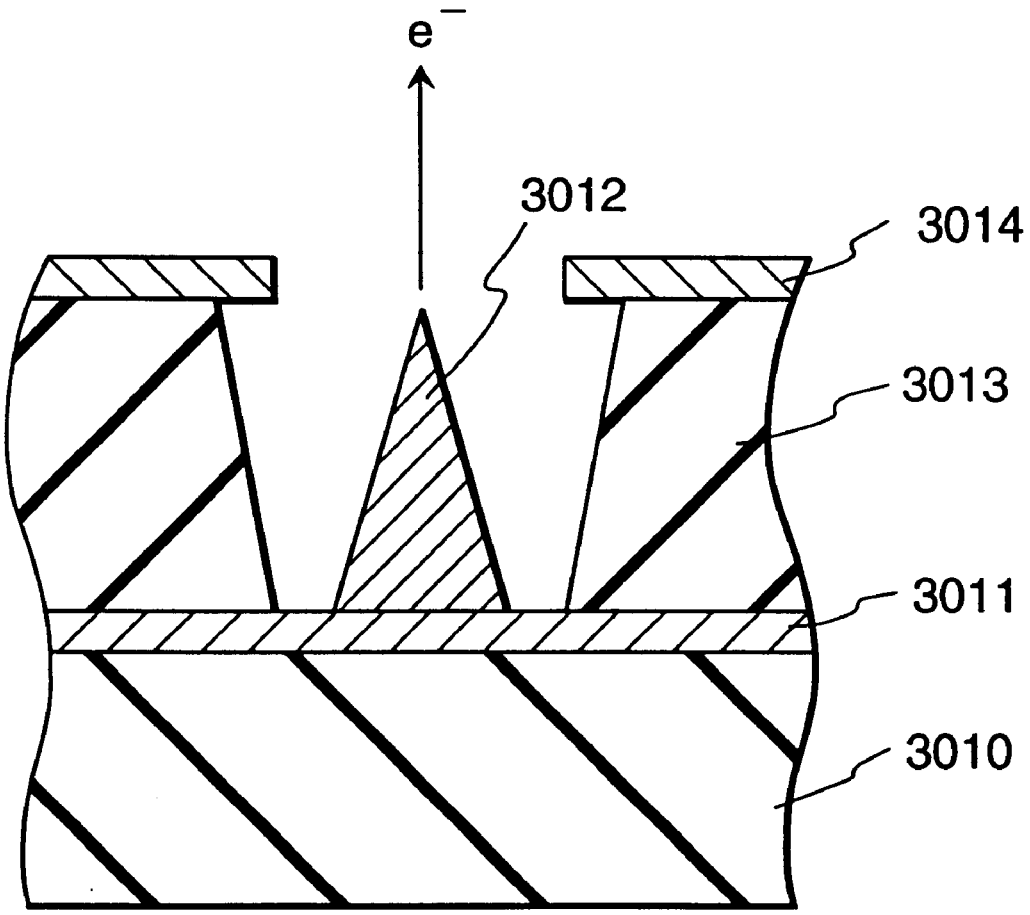
FIG. 5 PRIOR ART
FIG. 5 is a sectional view showing a field emission type electron-emitting device by Spindt.
Figure 6:
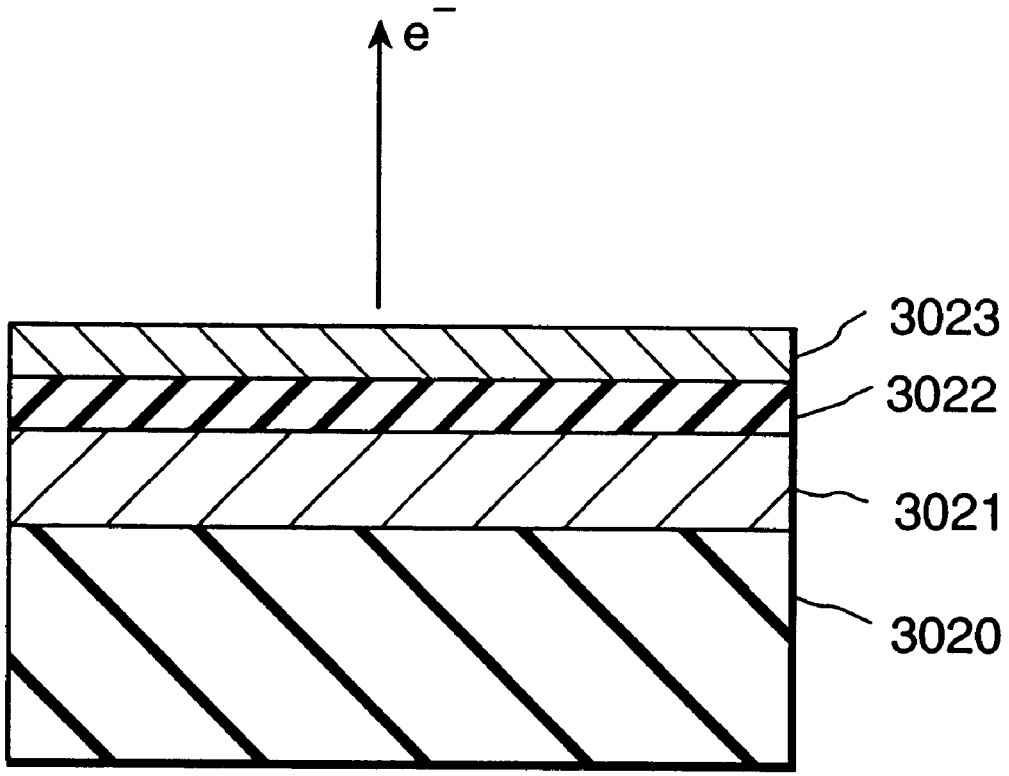
FIG. 6 PRIOR ART
FIG. 6 is a sectional view showing an MIM (Metal/Insulator/Metal) type electron-emitting device.
Figure 7:
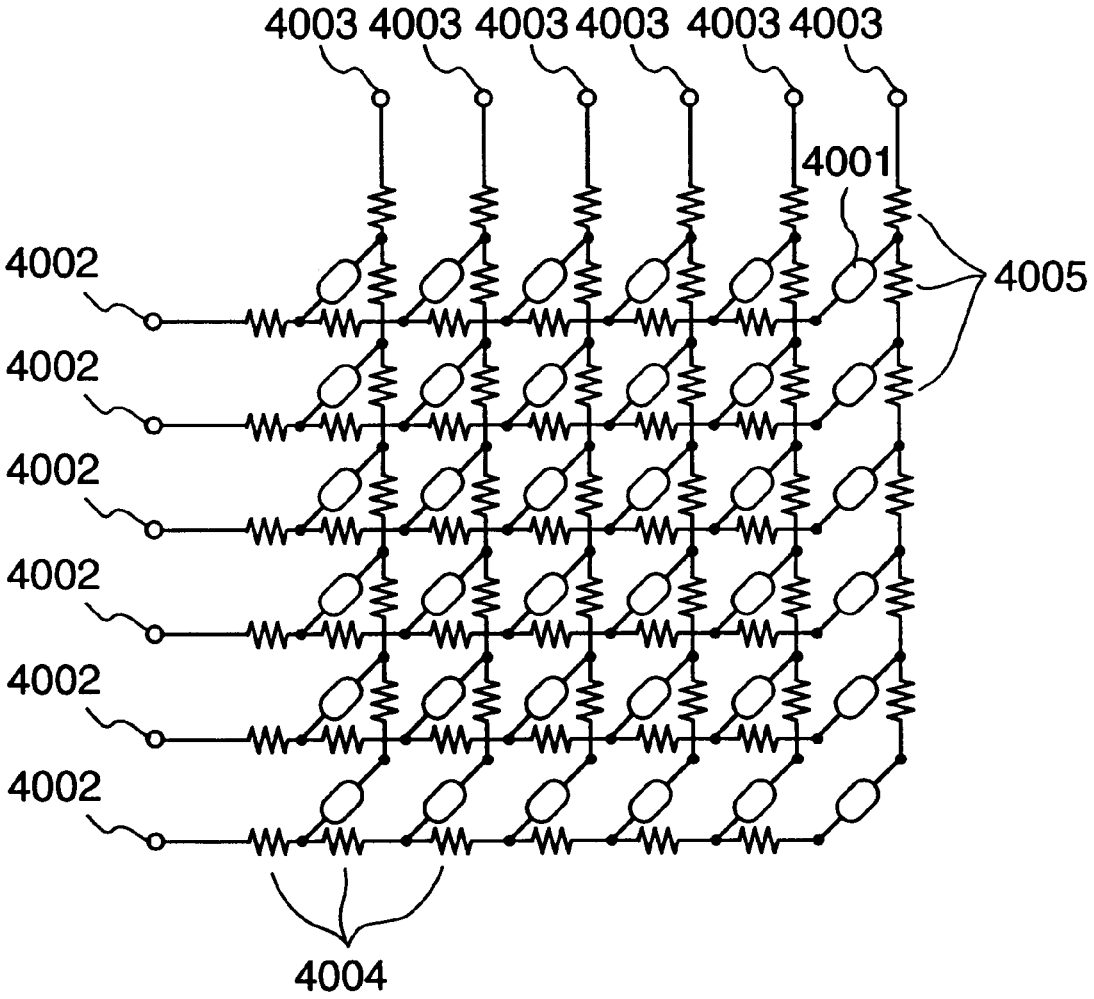
FIG. 7 PRIOR ART
FIG. 7 is a diagram showing a two-dimensional electron source by resistance connection.
Figure 8:
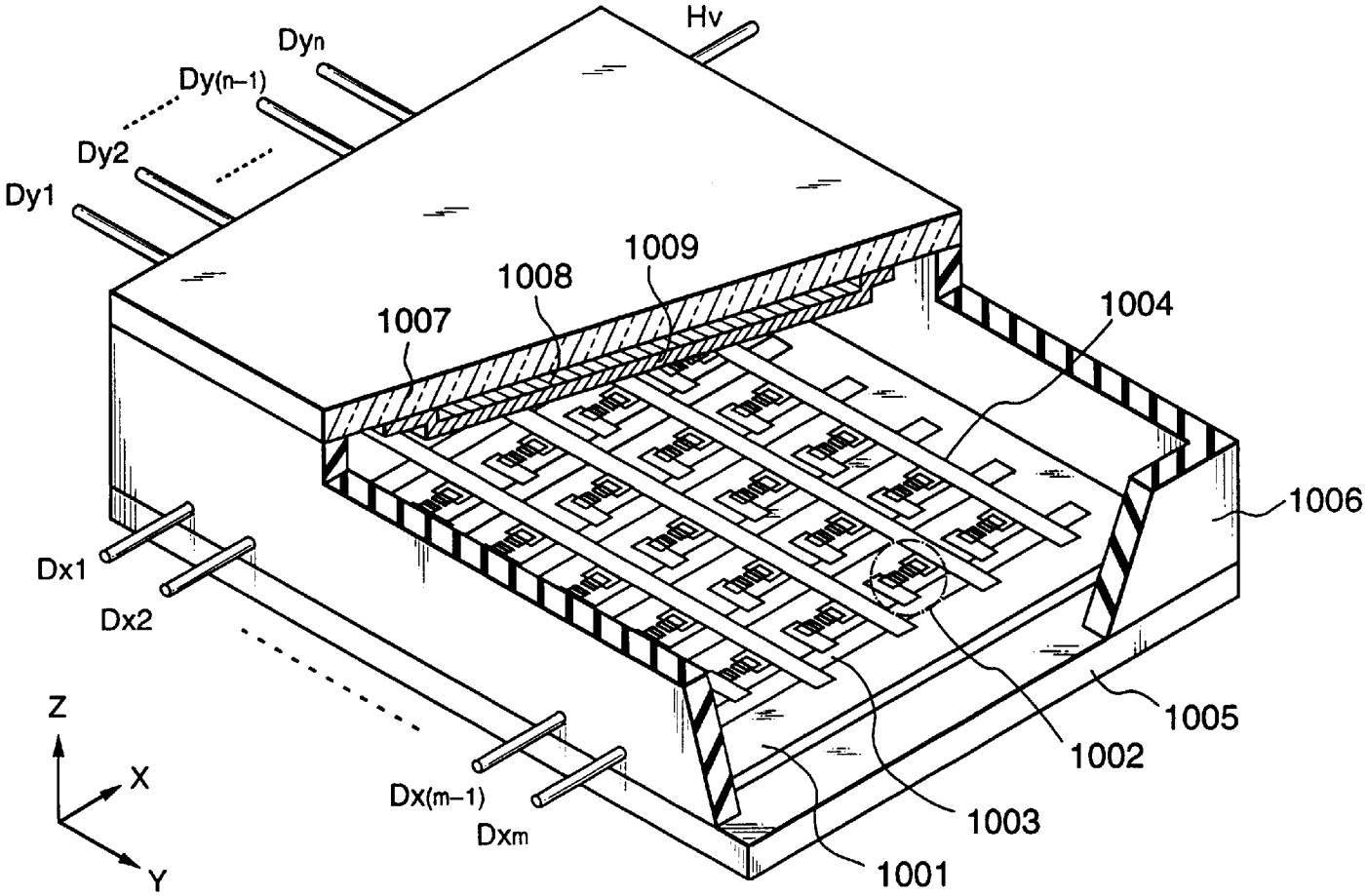
FIG. 8 PRIOR ART
FIG. 8 is a perspective view showing an image display panel using a surface-conduction emission type electron-emitting device.
Figure 9A:
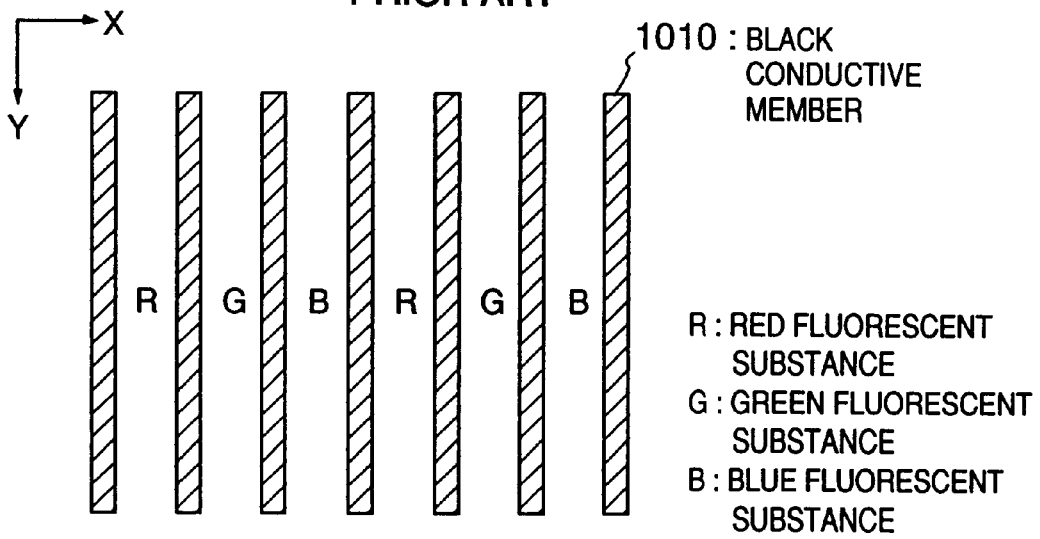
FIG. 9A PRIOR ART
FIGS. 9A and 9B are plan views each showing the layout of fluorescent substances of three primary colors.
Figure 9B:
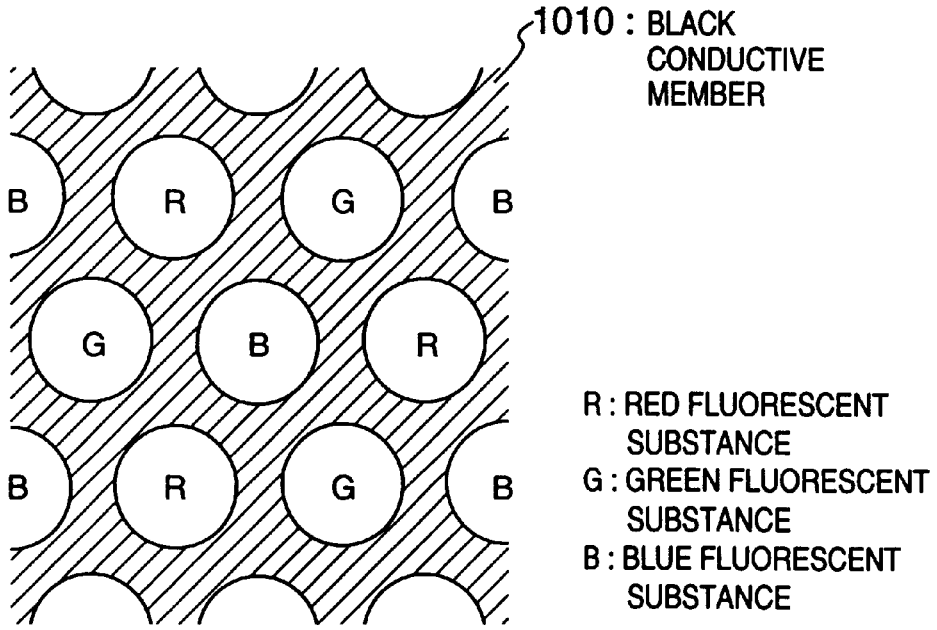
FIG. 9B PRIOR ART

FIG. 3 is a block diagram showing a V/I converter 108 and voltage limiting circuit 209 used in the second embodiment. The second embodiment has almost the same arrangement as the first embodiment except that the limit value setting circuit 110 and spike current absorbing means 211 are not installed for each wiring and are shared by a plurality or all of the wirings.

A voltage limiting circuit 309 adopts diodes D for respective wirings. These wirings are connected on their cathode side to share the limit value setting circuit and spike current absorbing means.

A necessary capacitance Cs of the capacitor C used in the spike current absorbing means 211 may be the same as the capacitance calculated in the first embodiment. The remaining arrangement and the like are the same as in the first embodiment.

The above-described arrangements can suppress degradation of device characteristics caused by application of a spike-like voltage even if discharge occurs between face and rear plates while a voltage of several kV to several ten kV is applied between them in the display panel.

In driving, by a current, surface-conduction emission type electron-emitting devices arranged in a simple matrix, the current driver tries to flow a current up to a given set value because the driving parameter is a current value. Especially when many surface-conduction emission type electron-emitting devices are arranged in a large area, the current varies between them. This variation is the resistance component of each surface-conduction emission type electron-emitting device. For a high resistance, the current driver tries to flow a set current value and may apply a voltage exceeding the performance of the surface-conduction emission type electron-emitting device. This problem is solved in the arrangements of the above embodiments. Matching of an image information signal can be maintained, any image display error can be prevented, and degradation of the characteristics of the surface-conduction emission type electron-emitting device can be suppressed.

The electron-emitting device is not limited to the surface-conduction emission type electron-emitting device, and can be an FE type or MIM type electron-emitting device.

The current driver drains a current in the above embodiments, but may absorb a current. In this case, the diode polarity of the limiting circuit and the reference potential are set in accordance with the arrangement of the current driver.

The above-described embodiments enable emitting a constant amount of electrons from the electron source while preventing characteristic degradation and destruction of the electron source in a multi electron source driving apparatus obtained by arranging surface-conduction emission type electron-emitting devices in a simple matrix. Accordingly, the multi electron source driving display apparatus can display an image on its entire display screen with a luminance faithful to an original image signal.

The present invention can realize a preferable electron-beam apparatus and image forming apparatus.

As many apparently widely different embodiments of the present invention can be made without departing from the spirit and scope thereof, it is to be understood that the invention is not limited to the specific embodiments thereof except as defined in the appended claims.

What is claimed is:

1. An electron-beam apparatus comprising:

an airtight container having an electron-emitting device, a wiring connected to the electron-emitting device, and an electrode which receives a potential for accelerating an electron emitted by the electron-emitting device; and a current absorbing unit which can be electrically connected to the wiring, said current absorbing unit absorbing a current generated by discharge in said airtight container.

2. The apparatus according to claim 1, wherein the electron-emitting device includes a plurality of electron-emitting devices, the wiring includes wirings for the respective electron-emitting devices, and said current absorbing unit includes current absorbing units arranged in correspondence with the respective wirings.

3. The apparatus according to claim 1, wherein the electron-emitting device includes a plurality of electron-emitting devices, the wiring includes wirings for the respective electron-emitting devices, and said current absorbing unit corresponds to the plurality of wirings.

4. The apparatus according to claim 1, wherein the wiring is a first wiring, the apparatus further comprises a second wiring, and the electron-emitting device is connected to the first and second wirings.

5. The apparatus according to claim 1, wherein the electron-emitting device is a surface-conduction emission type electron-emitting device.

6. The apparatus according to claim 1, wherein the electron-emitting device is a field emission type electron-emitting device.

7. The apparatus according to claim 1, wherein the electron-emitting device is a metal/insulator/metal type (MIM type) electron-emitting device.

8. An image forming apparatus comprising:

the electron-beam apparatus defined in claim 1; and a fluorescent substance for emitting light upon irradiation of an electron emitted by the electron-emitting device.

9. The apparatus according to claim 1, wherein the discharge causes the generation of a spike-shaped voltage on the wiring.

10. The apparatus according to claim 1, wherein the discharge causes the generation of a spike voltage on the wiring.

11. An electron-beam apparatus comprising:

an airtight container having an electron-emitting device, a wiring connected to the electron-emitting device, and an electrode which receives a potential for accelerating an electron emitted by the electron-emitting device;

a bypass which can be electrically connected to the wiring; and a switch for electrically connecting the wiring and said bypass when discharge occurs in said airtight container.

12. The apparatus according to claim 11, wherein said switch operates depending on a potential difference between a wiring-side potential and a bypass-side potential.

13. The apparatus according to claim 12, wherein said switch receives a predetermined potential as the bypass-side potential.

14. The apparatus according to claim 12, wherein said switch is a diode.

15. The apparatus according to claim 11, wherein said bypass comprises absorbing means for absorbing a current generated by discharge.

16. The apparatus according to claim 11, wherein said bypass comprises a capacitor.

17. The apparatus according to claim 11, further comprising a driver for supplying a signal for driving the electron-emitting device to the wiring.

18. The apparatus according to claim 17, wherein said driver is a circuit for generating a current having a predetermined current value.

19. The apparatus according to claim 18, wherein said switch serves as a switch for electrically connecting said bypass and said driver when a potential at an output terminal of said driver for supplying a current to the wiring falls outside a predetermined range.

20. The apparatus according to claim 11, wherein the electron-emitting device includes a plurality of electron-emitting devices, the wiring includes wirings for the respective electron-emitting devices, and said bypass includes bypasses arranged in correspondence with the respective wirings.

21. The apparatus according to claim 11, wherein the electron-emitting device includes a plurality of electron-emitting devices, the wiring includes wirings for the respective electron-emitting devices, and said bypass corresponds to the plurality of wirings.

22. An electron-beam apparatus comprising:

an airtight container having an electron-emitting device, a wiring connected to the electron-emitting device, and an electrode which receives a potential for accelerating an electron emitted by the electron-emitting device;

a capacitor which can be electrically connected to the wiring; and a switch which is interposed between the wiring and said capacitor and electrically connects the wiring and said capacitor depending on a wiring-side potential, wherein said switch operates depending on a potential difference between the wiring-side potential and a capacitor-side potential.

23. The apparatus according to claim 22, wherein said switch is a diode.

24. The apparatus according to claim 22, wherein the electron-emitting device includes a plurality of electron-emitting devices, the wiring includes wirings for the respective electron-emitting devices, and said capacitor includes capacitors arranged in correspondence with the respective wirings.

25. The apparatus according to claim 22, wherein the electron-emitting device includes a plurality of electron-emitting devices, the wiring includes wirings for the respective electron-emitting devices, and said capacitor corresponds to the plurality of wirings.

26. The apparatus according to claim 22, further comprising a driver for supplying to the wiring a signal for driving the electron-emitting device.

27. The apparatus according to claim 26, wherein said driver is a circuit for generating a current having a predetermined current value.

28. The apparatus according to claim 22, wherein said switch receives a predetermined potential as the capacitor-side potential.

29. The apparatus according to claim 28, wherein said switch is a diode.

30. The apparatus according to claim 28, further comprising a driver for supplying to the wiring a signal for driving the electron-emitting device.

31. The apparatus according to claim 30, wherein said driver is a circuit for generating a current having a predetermined current value.

32. The apparatus according to claim 28, wherein the electron-emitting device includes a plurality of electron-emitting devices, the wiring includes wirings for the respective electron-emitting devices, and said capacitor includes capacitors arranged in correspondence with the respective wirings.

33. The apparatus according to claim 28, wherein the electron-emitting device includes a plurality of electron-emitting devices, the wiring includes wirings for the respective electron-emitting devices, and said capacitor corresponds to the plurality of wirings.

34. An electron-beam apparatus comprising:

an airtight container having an electron-emitting device, a wiring connected to the electron-emitting device, and an electrode which receives a potential for accelerating an electron emitted by the electron-emitting device; and a capacitor which can be electrically connected to the wiring, wherein said capacitor has an electrostatic capacitance of not less than 0.1 $\mu$F.

35. The apparatus according to claim 34, further comprising a switch which is interposed between the wiring and said capacitor and electrically connects the wiring and said capacitor depending on a wiring-side potential, wherein said switch is a diode.

36. The apparatus according to claim 34, wherein the electron-emitting device includes a plurality of electron-emitting devices, the wiring includes wirings for the respective electron-emitting devices, and said capacitor includes capacitors arranged in correspondence with the respective wirings.

37. The apparatus according to claim 34, wherein the electron-emitting device includes a plurality of electron-emitting devices, the wiring includes wirings for the respective electron-emitting devices, and said capacitor corresponds to the plurality of wirings.

38. The apparatus according to claim 34, further comprising a driver for supplying to the wiring a signal for driving the electron-emitting device.

39. The apparatus according to claim 38, wherein said driver is a circuit for generating a current having a predetermined current value.

40. An electron-beam apparatus comprising:

an airtight container having an electron-emitting device, a wiring connected to the electron-emitting device, and an electrode which receives a potential for accelerating an electron emitted by the electron-emitting device;

a capacitor which can be electrically connected to the wiring;

a switch, said switch serving as a switch for electrically connecting the wiring and said capacitor; and another switch for electrically connecting a bypass and a driver when a potential at an output terminal of the driver for supplying a current to the wiring falls outside a predetermined range.

41. The apparatus according to claim 40, wherein at least one of said switches is a diode.

42. The apparatus according to claim 40, further comprising a driver for supplying to the wiring a signal for driving the electron-emitting device.

43. The apparatus according to claim 42, wherein said driver is a circuit for generating a current having a predetermined current value.

44. The apparatus according to claim 40, wherein the electron-emitting device includes a plurality of electron-emitting devices, the wiring includes wirings for the respective electron-emitting devices, and said capacitor includes capacitors arranged in correspondence with the respective wirings.

45. The apparatus according to claim 40, wherein the electron-emitting device includes a plurality of electron-emitting devices, the wiring includes wirings for the respective electron-emitting devices, and said capacitor corresponds to the plurality of wirings.

46. An electron-beam apparatus comprising:

an airtight container having a plurality of electron-emitting devices, a plurality of wirings which are connected to the electron-emitting devices and arranged in correspondence with the respective electron-emitting devices, and an electrode which receives a potential for accelerating electrons emitted by the electron-emitting devices;

one bypass which can be electrically connected to the plurality of wirings; and switches for electrically connecting the wirings and said bypass, wherein at least one of said switches operates depending on a potential difference between the wiring-side potential and a bypass-side potential, and receives a predetermined potential as the bypass-side potential.

47. The apparatus according to claim 46, wherein said switches are arranged for the respective wirings.

* * * * *